US007314135B1

(12) United States Patent
Drotar

(10) Patent No.: US 7,314,135 B1
(45) Date of Patent: Jan. 1, 2008

(54) TAMPON AND MEDICATION HOLDER WITH DATE INDICATOR

(76) Inventor: Mary Catherine Drotar, 111 Washington Blvd., Oak Park, IL (US) 60302-4303

( * ) Notice: Subject to any disclaimer, the term of this patent is extended or adjusted under 35 U.S.C. 154(b) by 504 days.

(21) Appl. No.: 10/835,765

(22) Filed: Apr. 29, 2004

Related U.S. Application Data

(60) Provisional application No. 60/469,445, filed on May 10, 2003.

(51) Int. Cl.
*B65D 85/00* (2006.01)

(52) U.S. Cl. ..... 206/459.1; 206/534

(58) Field of Classification Search ..... 206/459.1, 206/534, 37, 38, 581, 440; 40/310; 116/308
See application file for complete search history.

(56) References Cited

U.S. PATENT DOCUMENTS 2,739,564 A * 3/1956 North ..... 116/308
3,818,858 A * 6/1974 Kramer et al. ..... 116/308
4,621,670 A * 11/1986 Yuen ..... 220/801
4,848,588 A 7/1989 Rasmussen
4,909,382 A * 3/1990 Cuppari ..... 206/5.1
5,004,106 A 4/1991 Blumstock
5,016,262 A * 5/1991 Cushing ..... 377/15
5,046,620 A 9/1991 Barabino
D365,251 S * 12/1995 Lo ..... D7/629
5,730,294 A 3/1998 Blosser
5,803,282 A * 9/1998 Chen et al. ..... 215/228
6,000,159 A * 12/1999 Hornung ..... 40/307
6,039,175 A 3/2000 Wright
6,056,118 A * 5/2000 Hargus et al. ..... 206/438
D439,744 S * 4/2001 Ho ..... D3/323
6,412,637 B1 * 7/2002 Saunders et al. ..... 206/541
6,705,465 B2 3/2004 Ling

* cited by examiner

*Primary Examiner*—David T. Fidei
(74) *Attorney, Agent, or Firm*—Alvin S. Blum

(57) ABSTRACT

A unitary apparatus is provided that includes in one device a holder for one or more prepackaged feminine hygiene absorbers, related medication, and a date indicator. In one form it is a portable device that may be compact enough to be carried inconspicuously in a purse. It may carry other related articles such a panty liner, as well. The date indicator is for indicating onset of menses. It requires no pencil, calendar, or other item that might be lost or misplaced.

3 Claims, 5 Drawing Sheets

TAMPON AND MEDICATION HOLDER WITH DATE INDICATOR

This is a utility patent application based on, and claiming the benefit of, provisional patent application Ser. No. 60/469,445 filed on May 10, 2003 entitled TAMPON HOLDER WITH ATTACHED MEDICATION COMPARTMENT AND BUILT-IN DATE INDICATOR.

BACKGROUND OF THE INVENTION

This invention relates to catamenial accessories and more particularly to a unitary holder for holding one or more prepackaged tampons, menstrual medications such as analgesics, and a date indicator for indicating a date related to the menstrual period. The date of onset of last menses is very important to most women. U.S. Pat. No. 4,848,588 issued Jul. 18, 1989 to Rasmussen discloses a holder for feminine hygiene supplies that includes a slide out tray with a calendar and detachable pencil for recording the date. It is much too large to be carried inconspicuously in a lady's purse. It does not provide a suitable compartment for medications such as pain pills. The pencil and calendar may be used for other purposes and are easily misplaced.

SUMMARY OF THE INVENTION

It is accordingly an object of the invention to provide a compact unitary holder that can be conveniently carried in a purse that is devoted exclusively to this purpose. These and other objects, features, and advantages of the invention will become more apparent when the detailed description is studied in conjunction with the drawings in which like elements are designated by like reference characters in the various drawing figures.

This product was designed to provide women with a simple and discreet way to carry, store and protect the necessary items during their period, namely tampons and pain relief medication. The larger style holders can also accommodate panty liners and/or sanitary napkins. In addition, this product includes a date indicator that can record the date of the woman's last period. The term "tampon" refers to a single tampon individually prepackaged together with its associated applicator.

Purposes of my invention are:

- To provide a holder that provides necessary items during a woman's period, including a tampon holder and a medication compartment for pain relief medication. The larger style holders can also accommodate panty liners and/or sanitary napkins.
- To provide a mechanism for a woman to record the date she had her last period. This serves as an important reminder, so the holder is carried at the necessary time.
- To provide a discreet, damage resistant and sanitary method of transporting or storing one or more individual pre-packaged tampons.
- To provide a sanitary and convenient compartment to transport medication during a woman's period.
- To provide multiple sized containers depending on the woman's individual needs.
- Tampon capacity can range from 1-3 tampons, 4-8 tampons in larger styles, 10-20 tampons for a weekend holder, and a greater number of tampons for a week holder or home holder.

Advantages of Tampon Holder with Attached Medication Compartment and Built-in Date Indicator.

Although others have invented tampon holders, my invention is superior because:

- it is more then just a tampon holder; it also includes a date indicator and medication compartment.
- It simplifies a woman's life by having the necessary amenities for a period within one holder.
- It serves to remind a woman the next time her period is approaching with the date indicator.
- Various sizes of holders are available to meet the individual needs of women.
- The home holder provides a more convenient alternative to the cardboard packaging provided by the manufacturer, and provides better protection from humidity and moisture typically encountered in a bathroom environment.

DETAILED DESCRIPTION OF PREFERRED EMBODIMENTS

Figure 1:
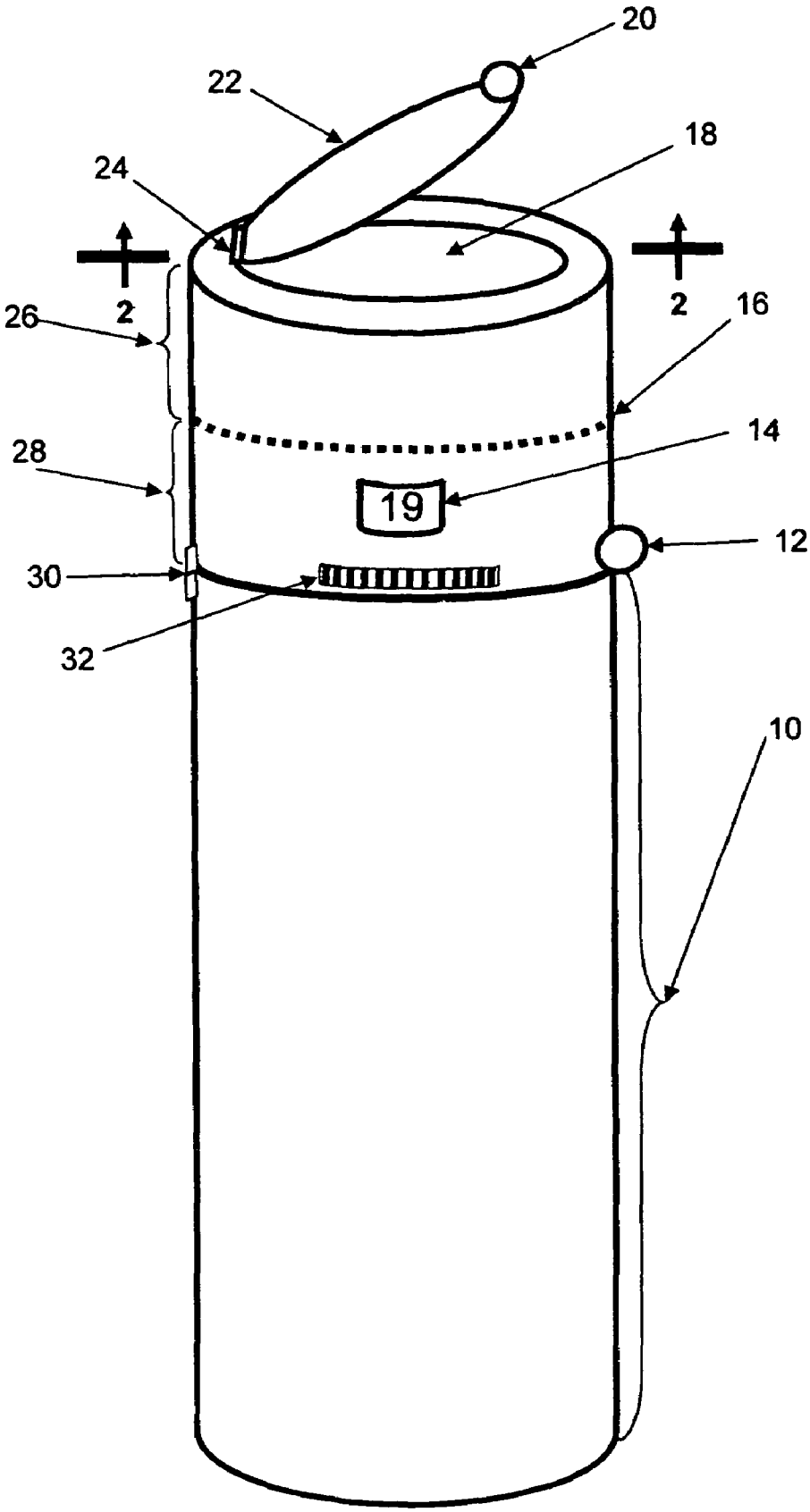
FIG. 1 is a perspective side view of the holder of the invention with medication lid open.
Figure 2:
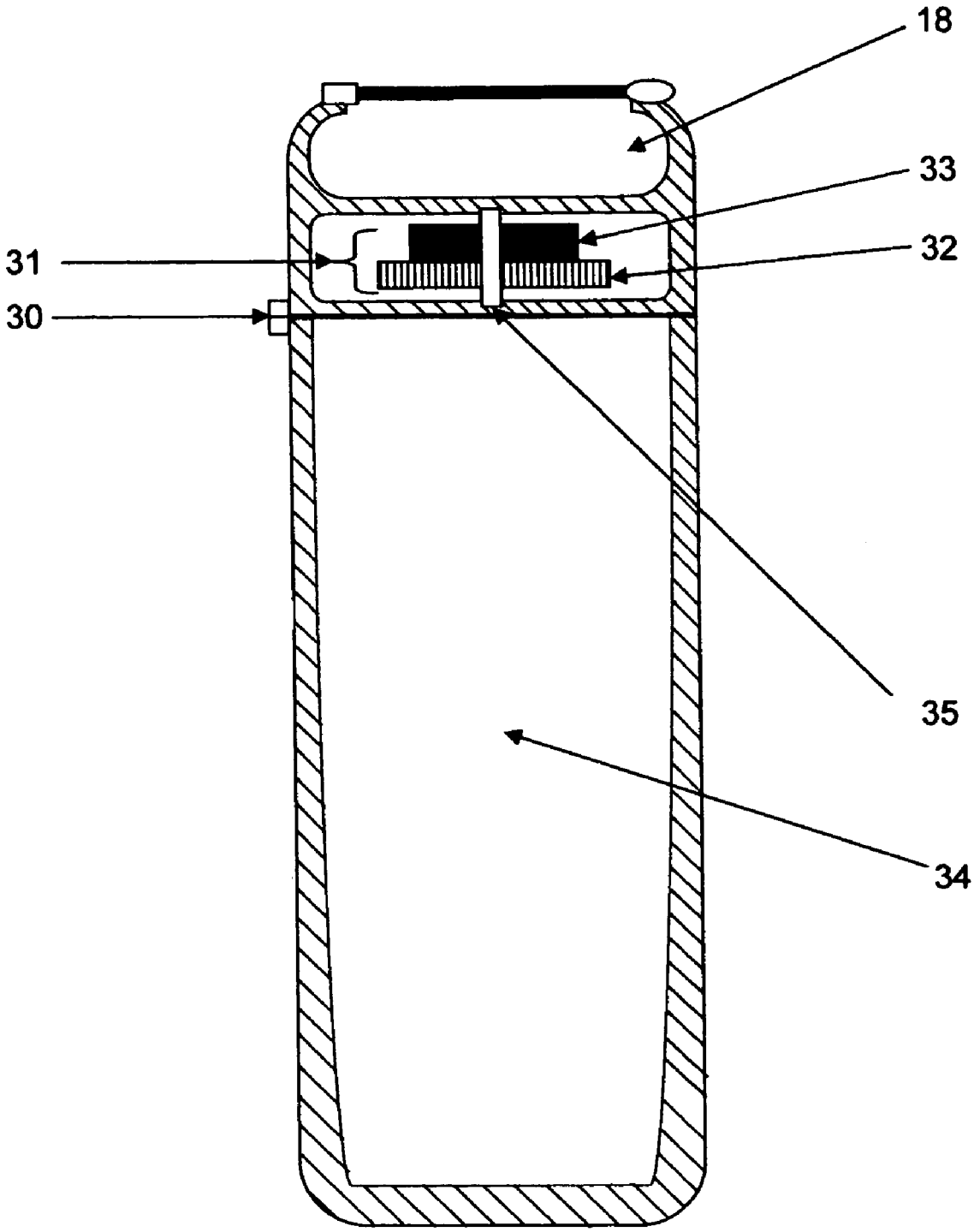
FIG. 2 is a sectional view taken through line 2-2 of FIG. 1.
Figure 3:
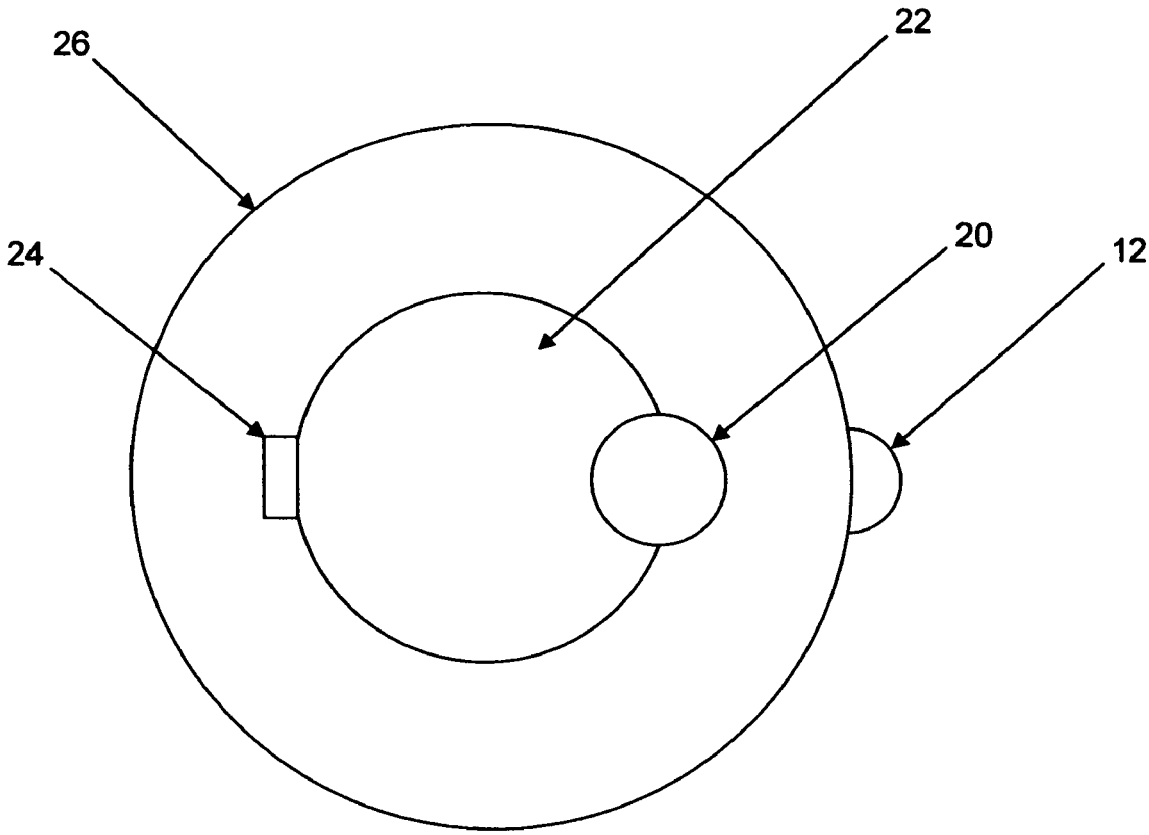
FIG. 3 is a top view of the holder.
Figure 4:
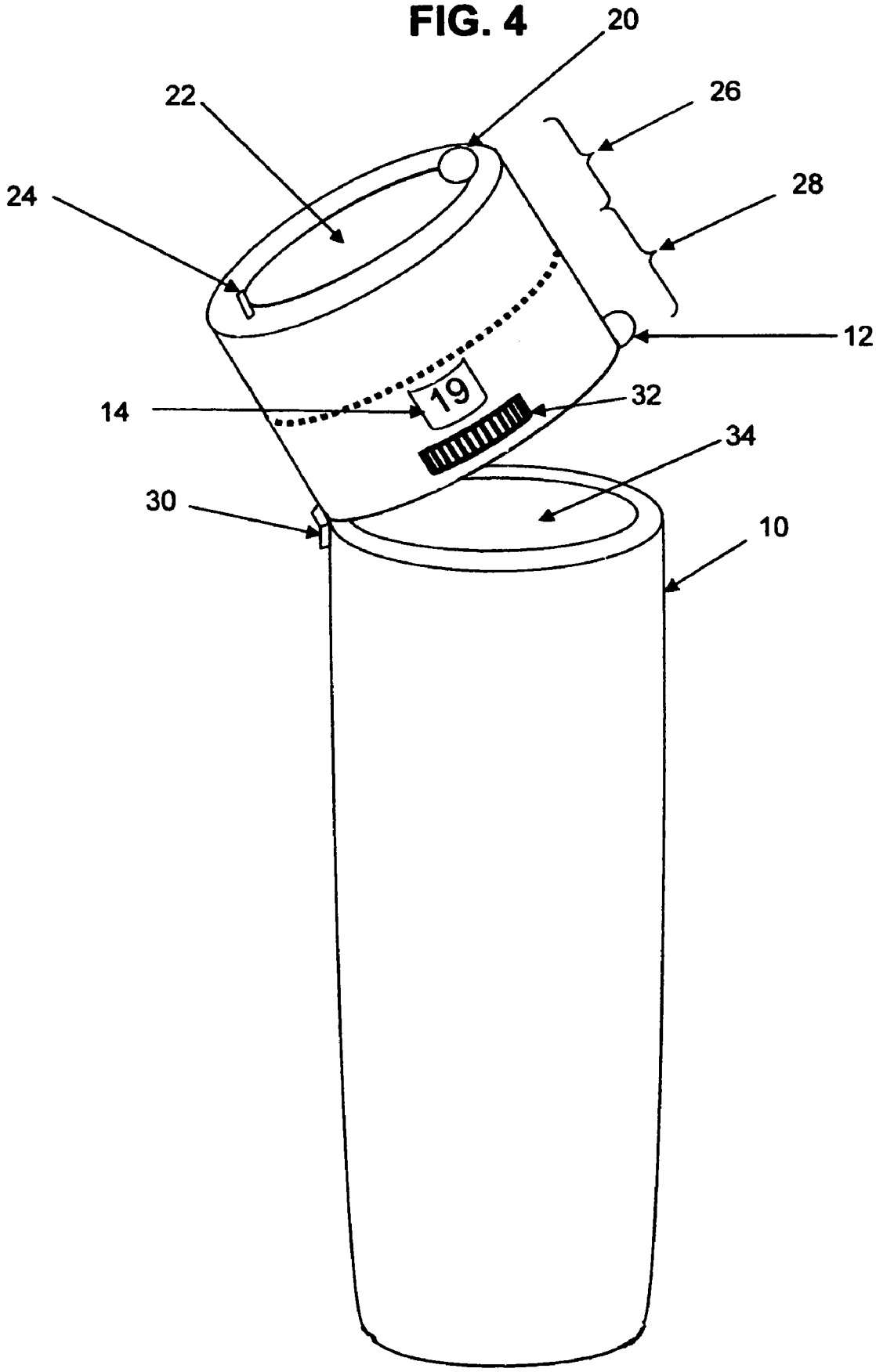
FIG. 4 is a perspective view of the holder with tampon compartment lid open.

Referring now to the drawing FIGS. 1-4, tampon holder compartment 34 has an interior length that is comparable to a single tampon, and sufficient width to accommodate one or more tampons positioned side-to-side. The interior of the tampon holder compartment is smooth, rounded, sanitary, and of rigid construction. Tampon holder housing 10 is mounted beneath date indicator housing 28 by means of hinge 30 and clasp 12 for a sanitary seal. Mounted above date indicator housing 28 is medication compartment housing 26. Date indicator housing 28 contains date indicator 31 that consists of thumb wheel 32, with attached date display wheel 33 on pivot 25 that is marked with numbers 1 through 31. Each date number is visible externally, one at a time, through date display window 14. The date indicator assembly 31 is provided with sufficient friction on pivot 25 so that it will not be accidentally turned. Medication compartment 18 lies above date indicator 31. Medication compartment lid 22 sealingly attaches to medication compartment housing 26 by means of hinge 24 and clasp 20. Medication compartment interior 18 is smooth, rounded, rigid and sanitary. Tampon holder with attached medication compartment and built-in date indicator is intended to store and/or transport medication and two or more tampons in a secure, sanitary, and convenient manner, as well as providing date information to the user. It fits easily and inconspicuously in a purse. In the disorder and unsanitary conditions of a public bathroom, having all of the necessary materials at hand in a unified article is a great advance in the art. The clasp 12 projecting from the cylindrical surface prevents the apparatus from rolling off a support surface and onto a dirty floor. In alternative embodiments, rolling of the device may be prevented by off-round structures, projections, flat or gripping surfaces, and the like. Tampon holder compartment 34 is accessible by manually actuating clasp 12 and lifting upper part of the device that includes both date indicator housing 28 and medication compartment housing 26 together, while connected to tampon holder compartment housing by hinge 30. Medication compartment 18 is accessed by actuating clasp 20 and lifting medication compartment lid 22 that is attached to medication compartment housing by hinge 24. Date indicator thumb wheel 32 is rotated by hand to select a date between 1-31 of the user's choosing that appears in date display window 14. A user may, for instance, choose to select a date corresponding to the first day of their current or previous period. Since the indicator is in hand at the time of onset of menstruation, there is less chance of forgetting to record, or incorrectly remembering a date of onset. This is a great advantage over the prior art.

Figure 5:
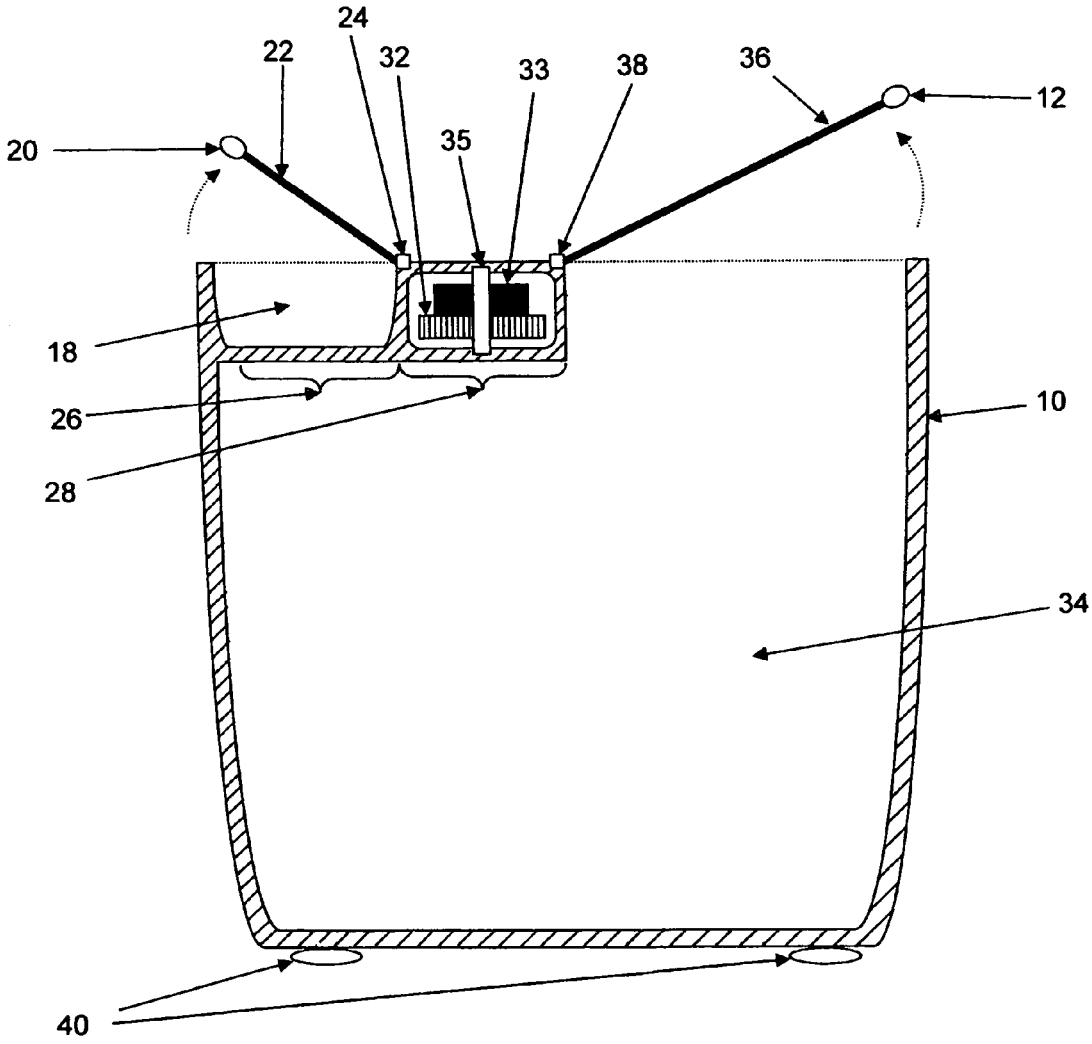
FIG. 5 is a sectional view of another embodiment of the invention.

Referring now to alternative embodiment of the invention shown in FIG. 5, which is better suited for home use, and facilitates the storage of larger numbers of tampons and greater quantities of medication than would normally be carried in a purse or bag. In this alternative configuration, securing feet 40 are provided to provide additional stability and grip on the flat surfaces typically encountered in a home environment. Date indicator housing 28 and medication compartment housing 26 are mounted side-by-side, both lying directly above tampon holder compartment 34. In this case, date indicator housing 28 is mounted in between medication compartment lid 22 and tampon compartment lid 36. Tampon holder compartment lid 36 is connected to tampon compartment housing 10 by means of hinge 38 and clasp 12. Tampon holder compartment 34 extends beneath medication compartment 26 and date indicator housing 28. This alternative configuration also includes securing feet 40. Internal and external components of tampon holder with attached medication holder and built-in date indicator can be produced with multiple materials, either separately or in combination, including fabric, vinyl, leather, plastic, metal, wood, and any other material that is suited for its use.

The tampon holder can vary in size. A holder that can be carried during the day can include 1-3 tampons, or in a larger style, 4-8 tampons. A weekend/week holder can contain 8-20 tampons, whereas the capacity for a home holder can include a larger number of tampons. The tampon holder can be of various shapes including but not limited to oval, triangular, square or circular. The term tampon holder may be applied as well to a holder for other feminine hygiene absorbent devices such as sanitary napkins.

As best seen in FIG. 5, the device may provide a compartment 34 dimensioned and constructed to hold sanitary napkins, panty liners, and the like. At the same time it includes a medication compartment 26, and an indicator 28 for indicating only a number from 1 to 31 for indicating a particular catamenial date, since the month is not required. Having all of these related elements on hand without any chance of them being separated is very reassuring to the user. It does not require use of a pencil or pen that may be borrowed and misplaced for other use. Since it only requires day of the month notation, it is less complex that other calendar/date notation apparatus.

The location of the medication holder and shape can take different forms depending on the size of the tampon holder.

The medication compartment can be omitted, and just the tampon holder and date indicator used for those individuals not needing medication.

The weekend/week/home holder can also have a dual hinged opening. In this case, one opening allows access to the tampons, while the other opening accesses the medication. The date indicator can either be located on the top, bottom or side of the container.

The capacity of the medication compartment may vary depending on the size of the tampon holder.

The medication compartment can have variations of styles as follows:

Single hinged lid with single compartment: Hinged lid lifts off one side of the compartment. Double hinged lid with double compartment: Opposing hinged lids and divider provides access to two separate compartments. Slide opening with single compartment: Lateral or rotary slide cover opens to provide access to single medication compartment. The built-in date indicator can consist of an electronic digital display, or a manually-operated display as shown in this document. The date indicator can be located other than as shown for enhanced manufacture or function. Clasp closure mechanisms can vary, and include, but are not limited to, one or more hinges, leather tabs, spring hinges, snaps and magnetic closures. The location of the clasp/opening can vary; the clasp can be located either on the side or the front of the tampon holder compartment housing, or medication compartment housing. Larger holders can accommodate panty liners or sanitary napkins. Depending on their length, these can be stored either horizontally or vertically.

The apparatus of the invention is unitary, i.e. all in one piece when assembled, exclusive of any battery. The user will not be able to separate the components, and forget to recombine them. Keeping the useful elements together when needed is a major object and feature of the invention.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A unitary holder comprising:

a) a first separate compartment constructed and dimensioned for sealingly containing at least one prepackaged tampon;

b) a second separate compartment constructed and dimensioned for sealingly containing medication related to catamenial conditions;

c) an adjustable date indicator that indicates only a number from 1 to 31 for indicating a particular catamenial date on the outside of the holder that is operable without accessories; and d) the first and second compartments and indicator being fixed together.

2. The unitary holder according to claim 1 in which the first compartment is further constructed and dimensioned for holding sanitary napkins and panty liners therein.

3. A unitary holder comprising:

a) a first separate compartment constructed and dimensioned for sealingly containing at least one prepackaged feminine hygiene absorber;

b) a second separate compartment constructed and dimensioned for sealingly containing medication related to catamenial conditions;

c) an adjustable date indicator that indicates only a number from 1 to 31 for indicating a particular catamenial date on the outside of the holder that is operable without accessories; and d) the first and second compartments and indicator being fixed together.

* * * * *